US005994826A

United States Patent [19]

Ueno et al.

[11] Patent Number: 5,994,826

[45] Date of Patent: Nov. 30, 1999

[54] COLOR CATHODE RAY TUBE

[75] Inventors: Hirofumi Ueno; Tsutomu Takekawa, both of Fukaya, Japan

[73] Assignee: Kabushiki Kaisha Toshiba, Kawasaki, Japan

[21] Appl. No.: 09/016,408

[22] Filed: Jan. 30, 1998

[51] Int. Cl.[6] ..... H01J 1/52

[52] U.S. Cl. ..... 313/413; 313/412; 313/414

[58] Field of Search ..... 313/412, 413, 313/414

[56] References Cited

U.S. PATENT DOCUMENTS 5,399,946 3/1995 Son et al. .

FOREIGN PATENT DOCUMENTS 0 509 590 A1 10/1992 European Pat. Off. .

0 646 944 A2 4/1995 European Pat. Off. .

8-87967 4/1996 Japan .

*Primary Examiner*—Vip Patel

*Attorney, Agent, or Firm*—Pillsbury Madison & Sutro LLP

[57] ABSTRACT

An electron gun comprises a supplementary grid applied with a voltage which dynamically changes in synchronization with a magnetic field generated by a deflection yoke, between a second grid and a third grid. Further, by the second grid, the supplementary grid, and the third grid, an electron is constructed which has an astigmatic aberration in which a focusing force in the horizontal direction is stronger than a focusing force in the vertical direction. The intensity of the astigmatic aberration of the electron lens is dynamically changed by a voltage applied to the supplementary grid.

10 Claims, 7 Drawing Sheets

COLOR CATHODE RAY TUBE

BACKGROUND OF THE INVENTION

The present invention relates to a color cathode ray tube, and particularly, to a color cathode ray tube which displays a high quality image by reducing elliptic deformation of beam spot shape in the peripheral portion of a fluorescent screen.

In general, an inline color cathode ray tube comprises an inline electron gun which emits a three electron beams including a center beam and a pair of side beams which run on one same plane and are arranged in one line in the horizontal direction. The three electron beams emitted from the inline electron gun are concentrated by themselves on a fluorescent screen by a non-uniform magnetic field which generates a deflection yoke, i.e., a pin-cushion type deflection magnetic field formed in the horizontal direction, and a barrel type deflection magnetic field formed in the vertical direction.

Various methods are known as an inline type electron gun as described above, and an electron gun adopting a Dynamic Astigmatism Correct and Focus method is one of those method. An electron gun adopting the Dynamic Astigmatism Correct and Focus method comprises three cathodes K arranged in one line in the horizontal direction, and first to fourth grids G1 to G4 arranged in this order in a direction from the cathodes K to a fluorescent screen. The third grid G3 includes two segments G3-1 and G3-2. Each of the grids G1 to G4 has three electron beam pass holes arranged in one line in the horizontal direction, in correspondence with the three cathodes K also arranged in one line in the horizontal direction.

In this electron gun, each of the cathodes K is applied with a voltage of about 150 V and the first grid G1 is grounded. The second grid G2 is applied with a voltage of about 700 V. Each of the first and second segments G3-1 and G3-2 of the third grid is applied with a voltage of about 6 kV. The fourth grid G4 is applied with a high voltage of about 26 kV.

By applying these voltages, the cathodes K, the first grid G1, and the second grid G2 constitute an electron beam generating section, and a virtual object point is formed with respect to a main lens described later. The second grid G2 and the first segment G3-1 constitute a pre-focus lens for preliminarily focusing electron beams emitted from the electron beam generating section. The second segment G3-2 and the fourth grid G4 constitute a main lens for finally focusing the electron beams preliminarily focused, onto a fluorescent screen.

In this electron gun, when electron beams are not deflected but run forwards to the center of the fluorescent screen, voltages of an equal level are applied to the first and second segments, and electron beams emitted from the electron beam generating section are focused onto the center of the fluorescent screen by the pre-focus lens and the main lens.

In case where electron beams are deflected to the periphery of the fluorescent screen, a predetermined voltage is applied to the second segment G3-2 in correspondence with a deflection amount of the electron beams. This voltage changes so as to gradually increase parabolically such that the voltage is lowest when electron beams are focused to the center of the fluorescent screen and the voltage is highest when electron beams are deflected to a corner of the fluorescent screen. When electron beams are deflected to a corner of the fluorescent screen, the potential difference between the second segment G3-2 and the fourth grid G4 is smallest and the intensity of the main lens is weakest. Simultaneously, a quadrupole lens is formed by a potential difference between the first segment G3-1 and the second segment G3-2 and the intensity of this lens is strongest. This quadrupole lens is arranged so as to cause convergence in the horizontal direction and divergence in the vertical direction. The quadrupole lens functions to correct a focus displacement caused by an increase of the distance which electron beams run before arriving at the fluorescent screen, and to also correct a deflection aberration generated by a pin-cushion type horizontal deflection magnetic field and a barrel type vertical deflection magnetic field of defection yokes.

However, as shown in FIG. 2A, a deflection aberration cannot be sufficiently corrected by an inline color cathode ray tube comprising a normal inline electron gun. Therefore, there is a problem that a beam spot B1 of an electron beam which has arrived at a center portion of the fluorescent screen has a substantially circular shape while a beam spot B2 of an electron beam deflected to a peripheral portion of the fluorescent screen is deformed to be longer in the horizontal direction. Specifically, the beam spot B2 is formed such that a core portion 1 of high luminance expanded in the horizontal direction and having a elliptic shape is surrounded by a halo portion 2 of low luminance expanded in the vertical direction.

In response to the above problem, according to an electron gun adopting a Dynamic Astigmatism Correct and Focus method, a halo portion 2 of the beam spot B2 deflected to a peripheral portion of a fluorescent screen is eliminated as shown in FIG. 2B by correcting a deflection aberration as described above, so that electron beams are subjected to focusing over the entire fluorescent screen. However, in this kind of electron gun, elliptic deformation remains and the beam spot B2 is deformed to be longer in the lateral direction, at end portions of the horizontal axis H and the diagonal axis of the fluorescent screen. Therefore, moire is caused by an interference with electron beam pass holes in a shadow mask, so that the image quality of an image constituted by beam spots are degraded.

As a countermeasure for the above-described drawback, as shown in FIG. 1, grooves elongated in the lateral direction are formed in the side of the second grid G2 opposed to the first segment G3-1, thereby to weaken the focusing effect in the horizontal direction H caused by a pre-focus lens constructed by second grid G2 and the first segment G3-1 and to strengthen the focusing effect in the vertical direction V also caused by the pre-focus lens. Consequently, the diameter of the virtual object point in the horizontal direction H is reduced in relation to the main lens, and the diameter thereof in the vertical direction V is enhanced. As a result of this, the vertical diameter of a beam spot of an electron beam which has arrived at the fluorescent screen is enlarged, so that elliptic deformation of beam spots in the peripheral portion of the fluorescent screen is absorbed and moire is reduced.

However, in the method as described above, as the depth of a laterally elongated groove formed in the second grid G2 increases, elliptic deformation of a beam spot B2 is more absorbed in the peripheral portion of the fluorescent screen, while the vertical diameter of a beam spot B1 at the center portion of the fluorescent screen is enlarged so that the beam spot B1 is longitudinally elongated as shown in FIG. 2C. As a result, the resolution is degraded at the center portion of the fluorescent screen.

Specifically, where a priority is given to easy view of a displayed image at the center portion of the fluorescent screen, an image is degraded at the peripheral portion of the fluorescent screen. On the contrary, where a priority is given to a easy view of a displayed image at the peripheral portion of the fluorescent screen, the image is degraded at the center portion of the fluorescent screen. Thus, a conventional technique has a problem that a compromising design must be chosen for the entire fluorescent screen.

As described above, in order to obtain excellent image quality of a color cathode ray tube, excellent focusing characteristics relating to electron beams must be maintained over the entire fluorescent screen, and elliptic deformation of electron beam spots must be reduced. In a conventional electron gun adopting a Dynamic Astigmatism Correct and Focus method, by changing the intensity of the main lens in synchronization with a deflection current and by simultaneously forming the quadrupole lens, vertical halo portions of electron beams caused by a deflection aberration can be eliminated and focusing can be achieved over the entire fluorescent screen.

However, elliptic deformation of beam spots deformed to be laterally elongated at the peripheral portion of the fluorescent screen is apparent. If laterally elongated deep grooves are formed in the second grid G2 in order to absorb elliptic deformation of a beam spot at the peripheral portion of the fluorescent screen, the vertical diameter of a beam spot at the center portion of the fluorescent screen is enlarged and the resolution is degraded.

BRIEF SUMMARY OF THE INVENTION

The present invention has been made to solve the above problem, and has an object of providing a color cathode ray tube by which excellent focusing characteristics are maintained over the entire surface of a fluorescent screen and elliptic deformation of electron beam spots can be restricted over the entire surface of the fluorescent screen.

According to the present invention, there is provided a color cathode ray tube comprising: an electron gun including an electron beam generating section constructed by a cathode, first and second grids sequentially provided next to the cathode and apart from each other by a predetermined distance, to generate three electron beams arranged in line in a horizontal direction, a pre-focus lens constructed by the second grid and a third grid provided next to and apart from the second grid by a predetermined distance, to preliminarily focus the electron beams emitted from the electron beam generating section, a main lens constructed by the third grid and at least one other grid provided next to and apart from the third grid by a predetermined distance, to finally focus the electron beams preliminarily focused by the pre-focus lens, onto a fluorescent screen; and a deflection yoke for generating a pin-cushion type horizontal deflection magnetic field in which the electron beams emitted by the electron gun are deflected in the horizontal direction, and a barrel type vertical deflection magnetic field in which the electron beams are deflected in a vertical direction, characterized in that the electron gun includes a supplementary grid which is provided between the second and third grids and which is combined together with the second and third grids to construct an electron lens having an astigmatic aberration in which a focusing force in the vertical direction is stronger than a focusing force in the horizontal direction, and that the supplementary grid is applied with a voltage which dynamically changes in synchronization with the magnetic fields generated by the deflection yoke, thereby to dynamically change an intensity of the astigmatic aberration of the electron lens.

Further, according to the present invention, there is provided a color cathode ray tube comprising: an electron gun including an electron beam generating section constructed by a cathode, first and second grids sequentially provided next to the cathode and apart from each other by a predetermined distance, to generate three electron beams arranged in line in a horizontal direction, a pre-focus lens constructed by the second grid and a third grid provided next to and apart from the second grid by a predetermined distance, to preliminarily focus the electron beams emitted from the electron beam generating section, a main lens constructed by the third grid and at least one other grid provided next to and apart from the third grid by a predetermined distance, to finally focus the electron beams preliminarily focused by the pre-focus lens, onto a fluorescent screen; and a deflection yoke for generating a pin-cushion type horizontal deflection magnetic field in which the electron beams emitted by the electron gun are deflected in the horizontal direction, and a barrel type vertical deflection magnetic field in which the electron beams are deflected in a vertical direction, characterized in that the electron gun includes a supplementary grid which is provided along an equipotential surface of a potential difference between the second and third grids, an electron beam pass hole having a non-circular shape is formed in the supplementary grid, and the supplementary grid is applied with a voltage which dynamically changes in synchronization with a deflection current supplied to the deflection yoke such that the voltage applied to the supplementary grid is a predetermined level equivalent to a potential of the equipotential surface where the supplementary grid is provided during a non-deflection period when the electron beams are oriented so as to reach a center portion of the fluorescent screen while the voltage applied to the supplementary grid is a voltage having a difference from the voltage of the predetermined level, which increases in accordance with an increase of a deflection amount of the electron beams, during a deflection period when the electron beams are deflected to a peripheral portion of the fluorescent screen.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

In the following, embodiments of a color cathode ray tube according to the present invention will be explained with reference to the drawings.

Figure 1:
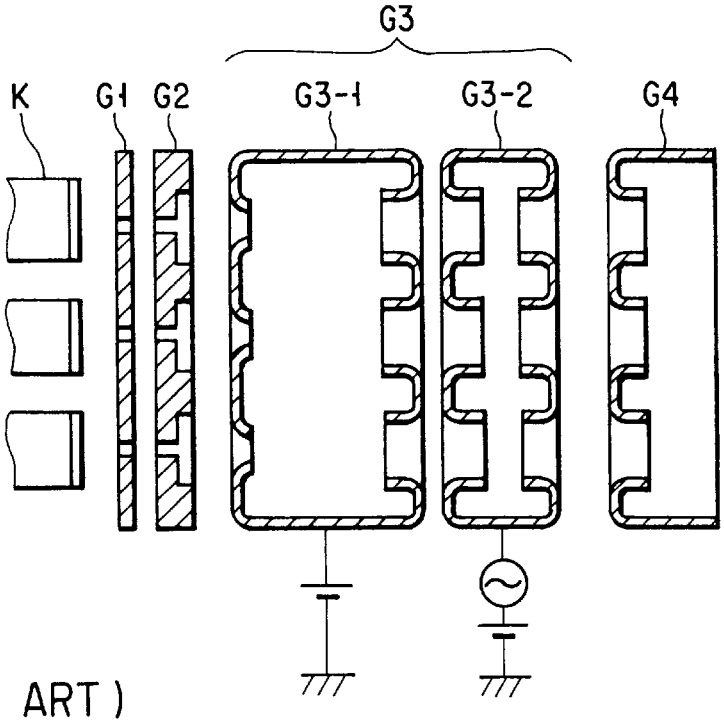
FIG. 1 (PRIOR ART)
FIG. 1 is a horizontal cross-setional view schematically showing the structure of a conventional electron gun.
Figure 2A:
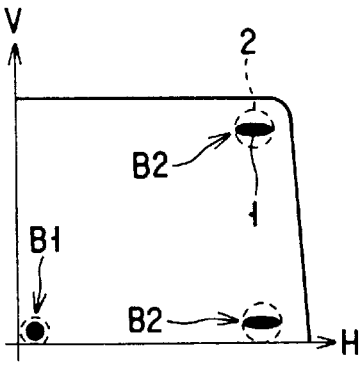
FIG. 2A (PRIOR ART)
FIGS. 2A to 2C are views for explaining elliptic deformation and halos of beam spots on a fluorescent screen, caused by a conventional electron gun.
Figure 2B:
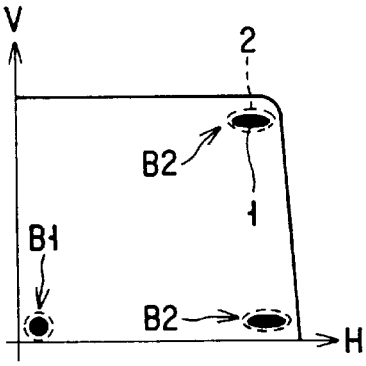
FIG. 2B (PRIOR ART)
Figure 2C:
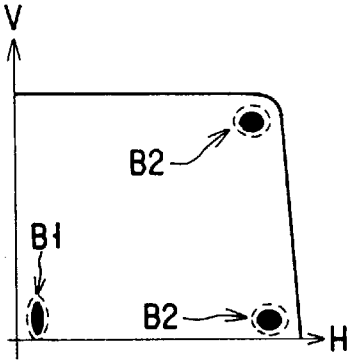
FIG. 2C (PRIOR ART)
Figure 3:
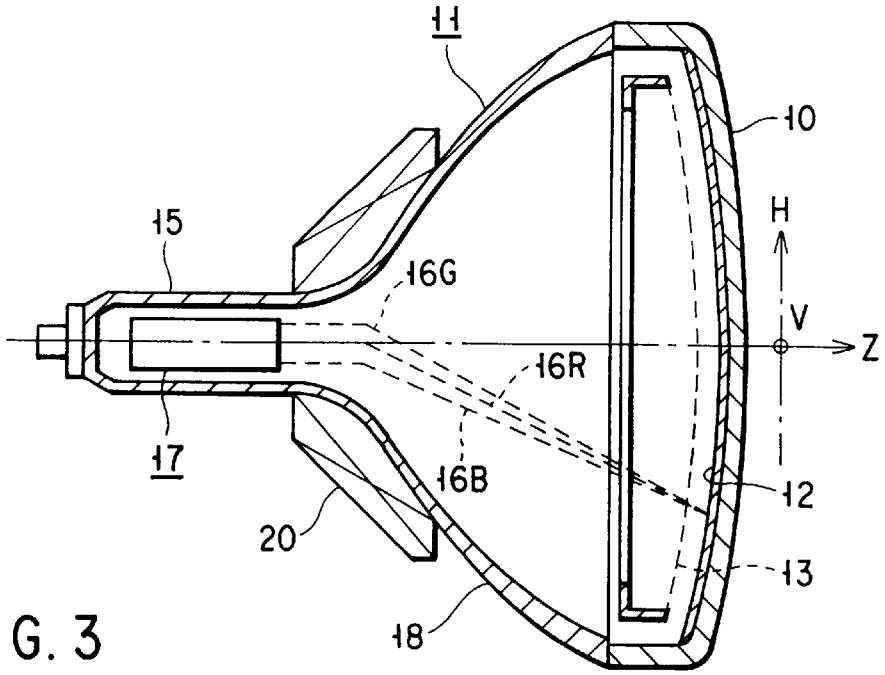
FIG. 3 is a horizontal cross-sectional view schematically showing the structure of a color cathode ray tube according to the present invention.

FIG. 3 is a cross-sectional view schematically showing a structure of an inline color cathode ray tube as an example of a color cathode ray tube according to the present invention.

The color cathode ray tube has an envelope consisting of a substantially rectangular panel 10 and a funnel 11. A fluorescent screen 12 consisting of three-color fluorescent layer which emits dotted light in blue, green, and red is provided inside the panel 10. In addition, a shadow mask 13 is also provided inside the panel 10, such that the shadow mask is opposed to the fluorescent screen 12. Meanwhile, an electron gun 17 is provided in a neck 15 of the funnel 11 and emits three electron beams of a center beam 16G and a pair of side beams 16B and 16R which pass in one same plane and are arranged in one line. A deflection yoke 20 for generating a pin-cushion type horizontal deflection magnetic field and a barrel type vertical deflection magnetic field is provided outside a boundary portion between a large diameter portion 18 and the neck 15 of the funnel 11. Further, three electron beams 16B, 16G, and 16R emitted from the electron gun 17 are deflected by the horizontal and vertical deflection magnetic fields generated by the deflection yoke 20 so as to horizontally and vertically scan the fluorescent screen 12, thereby displaying a color image.

Figure 4:
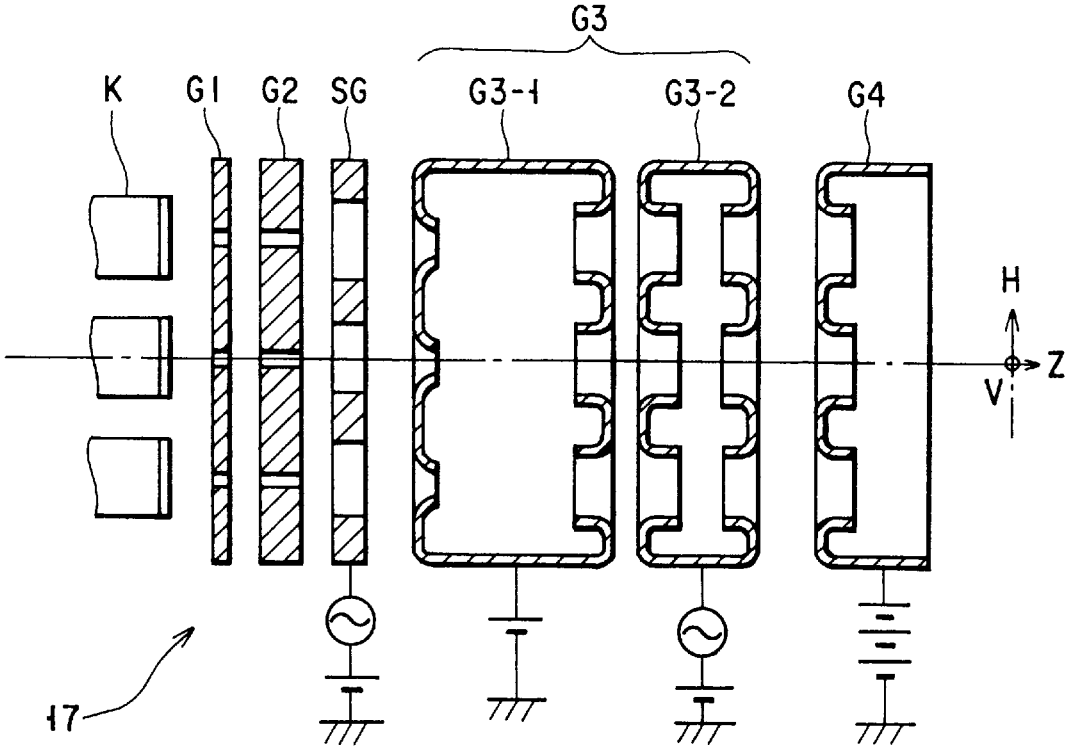
FIG. 4 is a horizontal cross-sectional view schematically showing the structure of an electron gun adopting a Dynamic Astigmatism Correct and Focus method, applied to the color cathode ray tube shown in FIG. 3.

FIG. 4 is a view schematically showing the structure of an electron gun of an inline type adopting a Dynamic Astigmatism Correct and Focus method, applied to the color cathode ray tube shown in FIG. 3.

As shown in FIG. 4, the electron gun 17 comprises three cathodes K arranged in line in the horizontal direction or the H-axis direction, three heaters (not shown) for respectively heating the cathodes K, and first to fourth grids G1 to G4 provided at predetermined intervals in this order in the tube axis direction or the Z-axis direction from the cathodes K to the fluorescent screen. The third grid G3 includes first and second segments G3-1 and G3-2 provided in this order in the Z-axis direction. In addition, a supplementary grid SG is provided between the second grid G2 and the first segment G3-1.

The first and second grids G1 and G2 are plate-like electrodes. In each of the plate-like electrodes, three electron beam pass holes each having a substantially circular shape are formed in line in the horizontal direction, so as to correspond to three cathodes K. The first segment G3-1 and the second segment G3-2 of the third grid G3 are tube-like electrodes, and three electron beam pass holes each having a substantially circular shape are formed in line in the horizontal direction, corresponding to the three cathodes K, in each of those surfaces of these electrodes facing any adjacent grid. The fourth grid G4 is a cup-like electrode, and three electron beam holes each having a substantially circular shape are formed in line in the horizontal direction, corresponding to the three cathodes K, in the surface of this electrode facing an adjacent grid.

Figure 5:
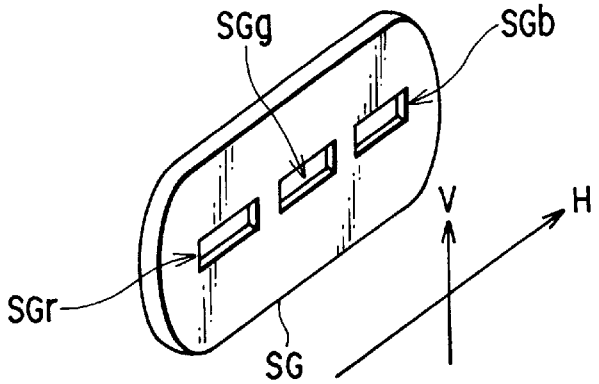
FIG. 5 is a perspective view showing a structure of supplementary grid applied to the electron gun shown in FIG. 4.

As shown in FIG. 5, the supplementary grid SG is a plate-like electrode, and three electron beam pass holes SGr, SGg, and SGb each having a non-circular shape are formed in line in the horizontal direction, corresponding to the three cathode K, in this electrode. Each of the three electron beam pass holes SGr, SGg, and SGb are formed such that the diameter in the horizontal direction or the H-axis direction is larger than the diameter in the vertical direction or the V-axis direction. In the example shown in FIG. 5, each of the three electron beam pass holes SGr, SGg, and SGb is laterally elongated and is formed in a rectangle having a long side in the H-axis direction and a short side in the V-axis direction.

In the electron gun 17, a voltage of about 150 V is applied to each cathode K. The first grid G1 is grounded, and the second grid is applied with a voltage of about 700 V. The first segment G3-1 of the third grid G3 is applied with a voltage of about 6 kV. The second segment G3-2 of the third grid G3 is applied with a voltage corresponding to a deflection amount of electron beams. Specifically, the second segment G3-2 is applied with a voltage which gradually increases parabolically in accordance with an increase of the deflection amount, such that the segment G3-2 is applied with the lowest reference voltage of about 6 kV equal to that applied to the first segment G3-1 when electron beams run toward the center portion of the fluorescent screen without deflection and the segment G3-2 is applied with the highest voltage when electron beams run toward a corner portion of the fluorescent screen. The fourth grid G4 is applied with a voltage of about 26 kV.

Figure 6A:
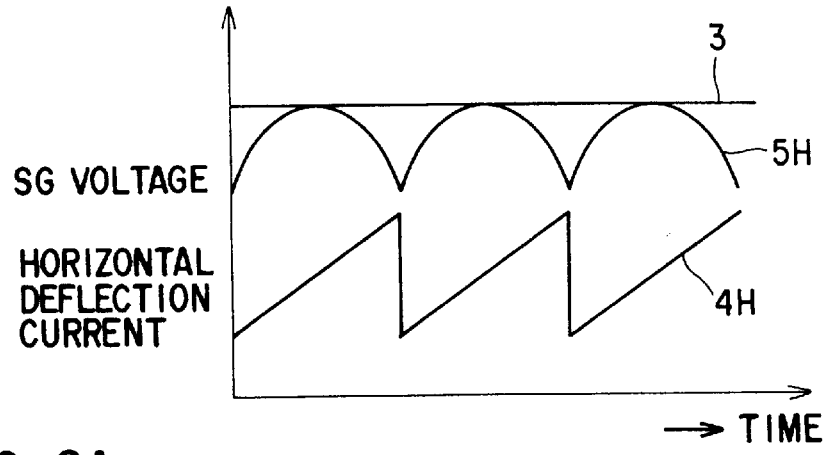
FIG. 6A is a graph showing a voltage applied to the supplementary grid shown in FIG. 5 in synchronization with a horizontal deflection current supplied to a deflection yoke.
Figure 6B:
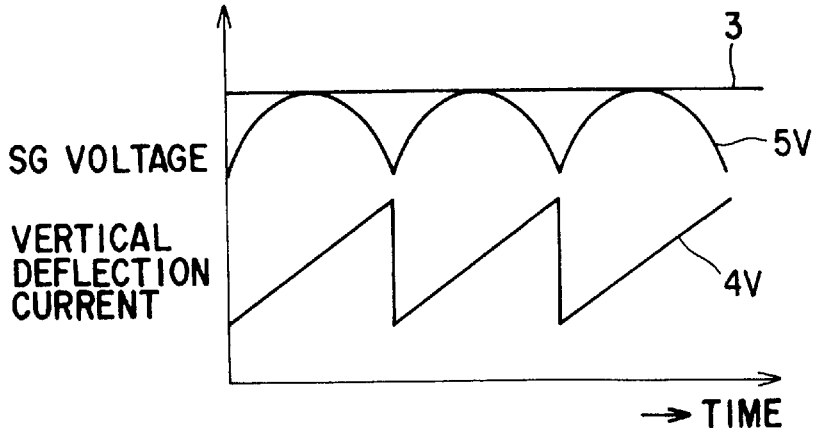
FIG. 6B is a graph showing a voltage applied to the supplementary grid in synchronization with a vertical deflection current.

The supplementary grid SG is applied with voltages which dynamically change in synchronization with the deflection magnetic field generated by the deflection yoke. Specifically, as shown in FIGS. 6A and 6B, the supplementary grid SG is applied with voltages 5H and 5V which decrease parabolically in synchronization with a horizontal deflection current 4H supplied to the deflection yoke for forming the horizontal deflection magnetic field and a vertical deflection current 4V supplied to the deflection yoke for forming the vertical deflection magnetic field, with respect to a reference voltage of a voltage 3 with which the potential distribution on the center axis of the electron beams from the second grid G2 to the third grid G3 is equal to that of a bi-potential type electron lens. The voltages 5H and 5V are highest during a non-deflection period in which electron beams are oriented toward the center portion of the fluorescent screen, and decrease parabolically from the highest voltage equal to the reference voltage 3 in accordance with an increase of the deflection amount during a deflection period in which electron beams are deflected toward a peripheral portion of the fluorescent screen.

By applying voltages as described above, electron beams are generated, and an electron beam generating section for forming a virtual object point with respect to a main lens is constructed, by the cathodes K and the first and second grids G1 and G2. A pre-focus lens for preliminarily focusing electron beams emitted from the electron beam generating section is constructed by the second grid G2, the supplementary grid SG, and the third grid G3. A main lens for finally focusing the electron beams focused preliminarily onto the fluorescent screen is constructed by the third and fourth grids G3 and G4.

In addition, in the third grid G3, a voltage of 6 kV is applied to each of the first and second segments G3-1 and G3-2 so that no potential difference is caused between both segments, during a non-deflection period when electron beams are oriented toward the center portion of the fluorescent screen. In contrast, during a deflection period when electron beams are deflected toward a peripheral portion of the fluorescent screen, the first segment G3-1 is applied with a voltage of 6 kV and the second segment G3-2 is applied with a voltage which changes parabolically in accordance with the deflection amount of electron beams, so that a potential difference is caused between both segments, thereby forming a quadrupole lens which compensates for a deflection aberration caused by the deflection yoke. The quadrupole lens is arranged so as to have a convergence characteristic in the H-axis direction and a divergence characteristic in the V-axis direction.

Next, the voltage applied to the supplementary electrode SG will be explained below in details.

Firstly, during a non-deflection period when electron beams are oriented to the center portion of the fluorescent screen, the voltage applied to the supplementary grid SG is set such that the potential distribution on the center axis O of the electron beam pass holes from the second grid G2 to the third grid G3 is the same as that of a bi-potential type electron lens.

Figure 7A:
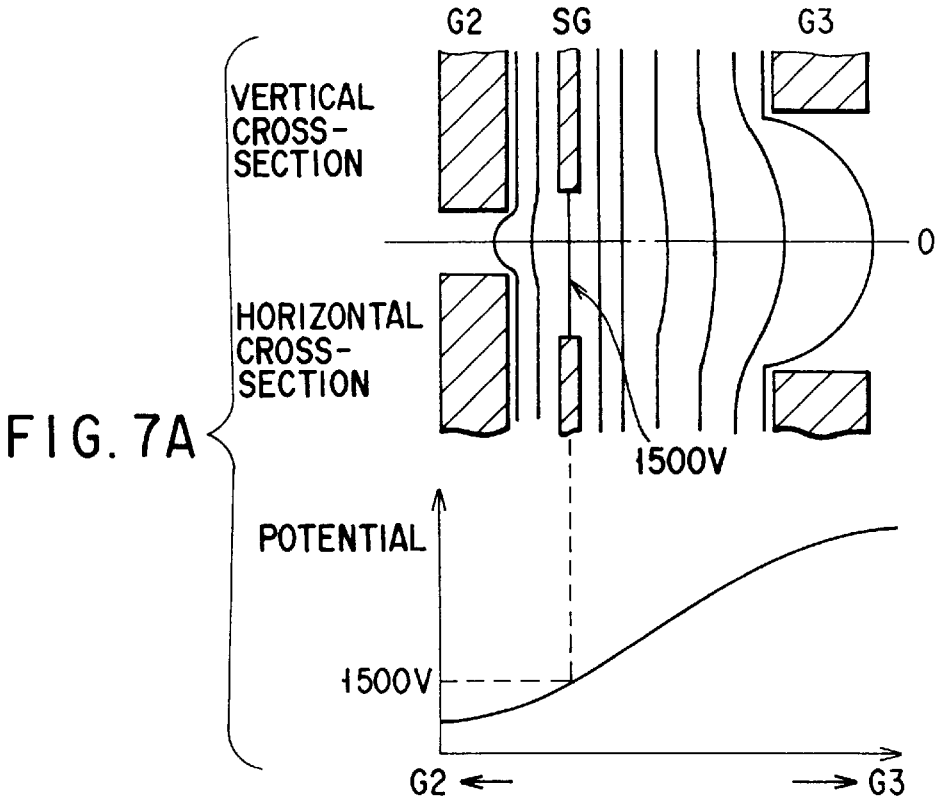
FIG. 7A is a view showing a potential distribution, formed from the second grid to the third grid of the electron gun shown in FIG. 4, in case of non-deflection.
Figure 7B:
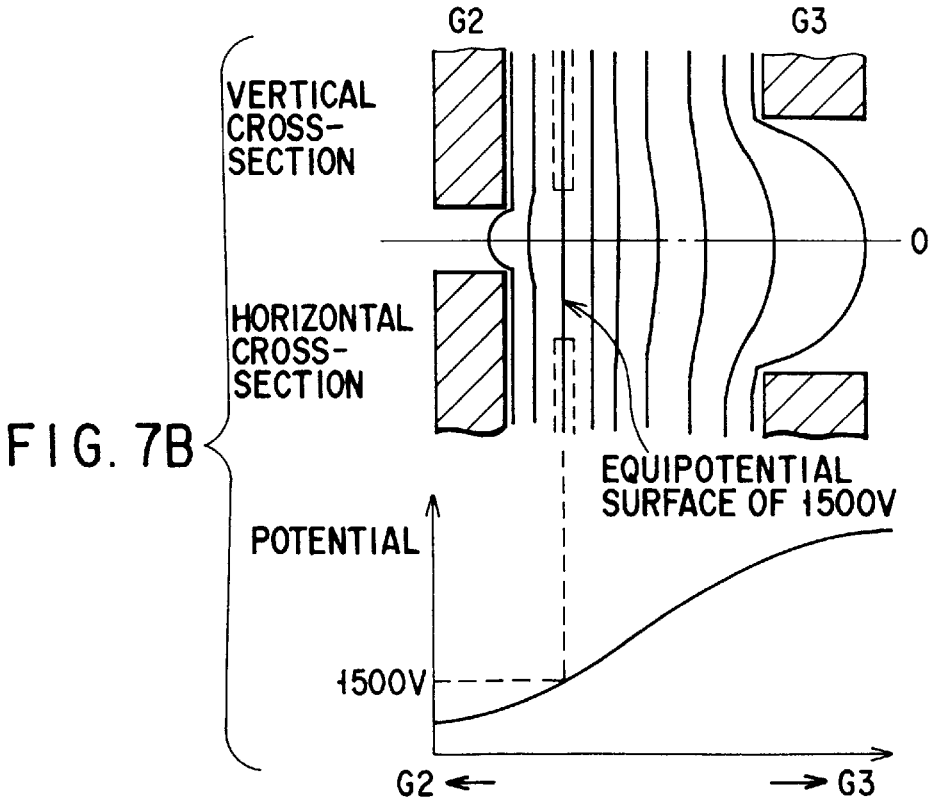
FIG. 7B is a view showing a potential distribution, formed from the second grid to the third grid shown in FIG. 4, in case of non-deflection where the supplementary grid is removed from the electron gun shown in FIG. 4.

FIG. 7A is a view showing a potential distribution on the center axis O of electron beam pass holes from the second grid 2 to the third grid 3 during a non-deflection period. FIG. 7B is a view showing a potential distribution where the supplementary grid SG is removed from the structure shown in FIG. 7A.

In FIG. 7B, the position of the supplementary grid SG shown in FIG. 7A is indicated by broken lines. As shown in FIG. 7B, where the supplementary grid is not provided, a pre-focus lens constructed by the second grid G2 and the third grid G3 is a bi-potential type electron lens which has a rotation-symmetrical shape, and has no astigmatic aberration. Supposing that the potential of an equipotential surface generated at the position of the supplementary grid SG indicated by the broken lines is here, for example, 1500 V, the potential distribution on the center axis O of electron beam pass holes between the second grid G2 and the third grid G3 can be the same as that of the bi-potential type electron lens shown in FIG. 7B, if the voltage applied to the supplementary grid SG is 1500 V in FIG. 7A.

Specifically, between the second grid G2 and the third grid G3, the supplementary grid SG is provided so as not to disturb the potential distribution to be formed on the center axis O of the electron beam pass holes when no supplementary grid SG is provided. In other words, the supplementary grid SG is provided along a predetermined equipotential surface in the potential distribution formed between the second grid G2 and the third grid G3, and the supplementary grid SG is applied with a voltage equal to the potential of the equipotential surface of the position where the supplementary grid SG is provided.

In this manner, as shown in FIGS. 7A and 7B, an equivalent potential distribution on the center axis of the electron beam pass holes is obtained in both cases of providing a supplementary grid SG and providing no supplementary grid SG. Further, a pre-focus lens constructed by the second grid G2, the supplementary grid SG, and the third grid G3 is equivalent to a rotation-symmetrical bi-potential type electron lens having no astigmatic aberration.

Therefore, during a non-deflection period, the diameter of a virtual object point with respect to the main lens of an electron gun is equalized in both the horizontal and vertical directions, and the beam spot of an electron beam which is finally focused and reaches the center portion of the fluorescent screen has a circular shape.

Figure 8:
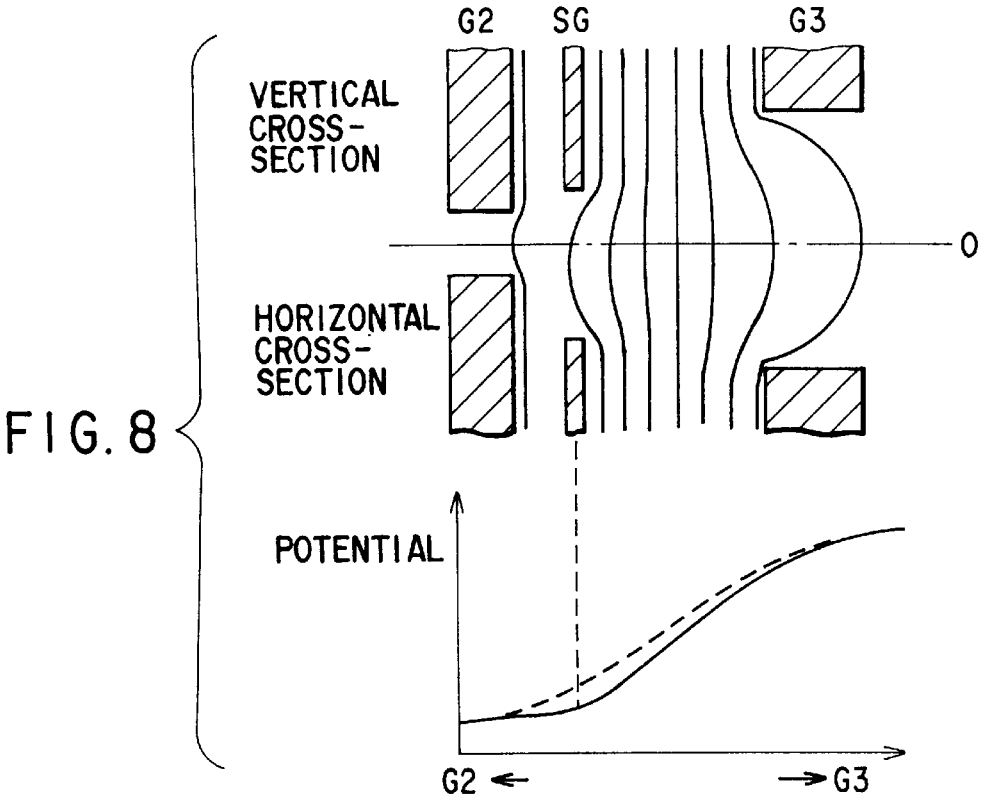
FIG. 8 is a view showing a potential distribution, formed from the second grid to the third grid of the electron gun shown in FIG. 4, in case of deflection.

Meanwhile, during a deflection period when electron beams are deflected toward a peripheral portion of the fluorescent screen, the voltage applied to the supplementary grid SG is set to a lower voltage than that applied during a non-deflection period. In other words, the supplementary grid SG is applied with a lower voltage than the potential of an equipotential surface at the position where the supplementary grid SG is provided. As a result of this, as indicated by a continuous line in FIG. 8, the potential in the vicinity of the supplementary grid SG is lower than that indicated by a dashed line during a non-deflection period, in the potential distribution on the center axis O of the electron beam pass holes from the second grid G2 to the third grid G3.

More specifically, supposing that the potential of an equipotential surface generated at the position where the supplementary grid SG is provided is, for example, 1500 V, the voltage applied to the supplementary grid SG may be set to, for example, 1000 V which is lower than that during a non-deflection period.

The supplementary grid SG is applied with a voltage which dynamically change in synchronization with a deflection magnetic field generated by a deflection yoke. Specifically, as shown in FIGS. 6A and 6B, the supplementary grid SG is applied with voltages 5H and 5V which parabolically decrease in accordance with an increase of the deflection amount of electron beams in synchronization with a horizontal deflection current 4H and a vertical deflection current 4V, with respect to a reference voltage of a voltage 3 equivalent to the potential of an equipotential surface generated at the position where the supplementary grid SG is provided. In other words, the supplementary grid SG is applied with a voltage 3 equivalent to a reference voltage as the highest voltage during a non-deflection period, and is applied with voltage which decreases in accordance with an increase of the deflection amount of electron beams during a deflection period so that the lowest voltage is applied when electron beams are deflected toward a peripheral portion of the fluorescent screen.

During the deflection period, a voltage which parabolically decreases is applied to the supplementary grid SG and the potential difference between the second grid G2 and the supplementary grid SG is reduced accordingly while the potential difference between the supplementary grid SG and the third grid G3 is increased also accordingly. Therefore, the effect of the electron lens constructed by the supplementary grid SG and the third grid G3 is more dominant. As a result, in the pre-focus lens constructed by the second grid, the supplementary grid SG, and the third grid G3, the focusing force in the horizontal direction is stronger than the focusing force in the vertical direction, thereby forming a non-rotation-symmetrical lens having a negative astigmatic aberration. This means that the potential distribution in the vertical direction is not symmetrical to the potential distribution in the horizontal direction. Accordingly, a virtual object point with respect to the main lens of electron beams has a smaller diameter in the horizontal direction and a larger diameter in the vertical direction, than those during a non-deflection period. In addition, the divergence angle of electron beams is enlarged in the horizontal direction and is reduced in the vertical direction, in comparison with those during a non-deflection period.

Electron beams which have passed through the pre-focus lens as described above are finally focused by a main lens constructed by the first and second segments G3-1 and G3-2 of the third grid G3, and the fourth grid G4, and reach the fluorescent screen.

In this case, since the second segment G3-2 is applied with a voltage which parabolically increases in accordance with an increase of the deflection amount of electron beams in synchronization with a deflection current supplied to the deflection yoke, the intensity of the main lens constructed by the second segment G3-2 and the fourth grid G4 is weakened in comparison with a non-deflection period, so that an increase of the distance which electron beams run to the fluorescent screen is compensated for. Simultaneously, the first and second segments G3-1 and G3-2 construct a quadrupole lens which has a positive astigmatic aberration, i.e., a stronger focusing force in the horizontal direction than that in the vertical direction, and correct a deflection aberration and a change of the divergence angle of electron beams caused by a negative astigmatic aberration in the pre-focus lens.

As a result, electron beams which have been finally focused by a main lens and have reached the fluorescent screen form an image in both the horizontal and vertical directions on fluorescent screen. The horizontal diameter of an electron beam spot on the fluorescent screen is reduced since the diameter of a virtual object point is reduced in the horizontal direction by a negative astigmatic aberration effected by the pre-focus lens, while the vertical diameter of the electron beam spot on the fluorescent screen is enlarged since the diameter of the vertical object point is enlarged in the vertical direction.

Figure 9:
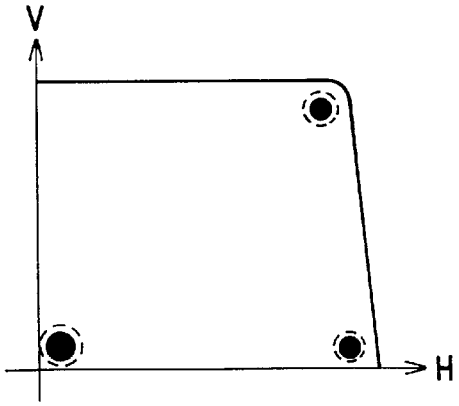
FIG. 9 is a view showing shapes of beam spots of electron beams on the fluorescent screen of the color cathode ray tube according to the present invention.

Accordingly, as shown in FIG. 9, elliptic deformation of beam spots of electron beams which arrived at a peripheral portion of the fluorescent screen is absorbed, so that beam spots each having a substantially circular shape can be obtained. In addition, focusing of electron beams can improve to be uniform over the entire surface of the screen, so that an image of excellent quality can be displayed.

In the embodiment described above, explanation has been made of a case where electron beam pass holes formed in the supplementary grid SG are not circular but have a laterally elongated shape. However, the shape of electron beam pass holes is not limited thereto.

Figure 10:
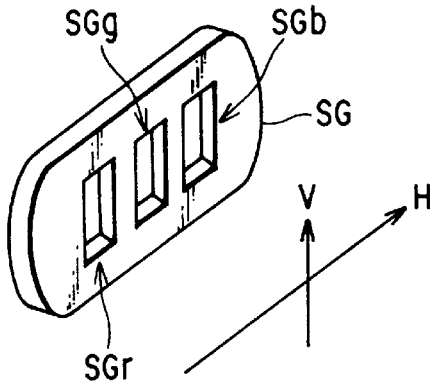
FIG. 10 is a perspective view showing another structure of a supplementary grid applicable to the electron gun shown in FIG. 4.

Specifically, the supplementary grid SG may be a plate-like electrode as shown in FIG. 10. In this plate-like electrode, three electron beam pass holes SGr, SGg, and SGb each having a non-circular shape elongated longitudinally are formed to be arranged in line in the H-axis direction, corresponding to three cathodes K. Each of the three electron beam pass holes SGr, SGg, and SGb is formed in a rectangular shape elongated vertically such that the diameter in the H-axis direction is smaller than that in the V-axis direction.

Figure 11A:
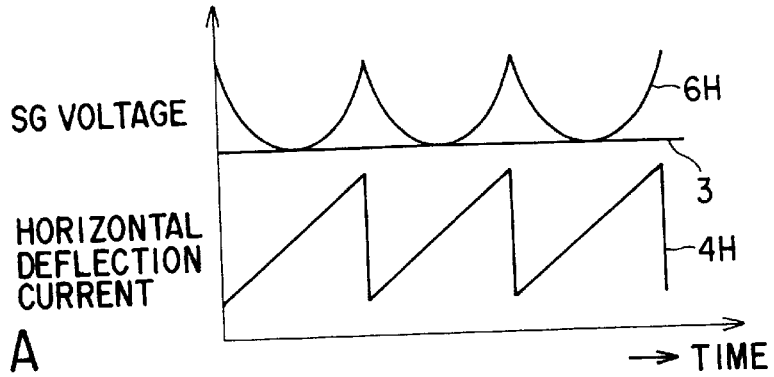
FIG. 11A is a graph showing a voltage applied to the supplementary grid shown in FIG. 10 in synchronization with a horizontal deflection current supplied to a deflection yoke.
Figure 11B:
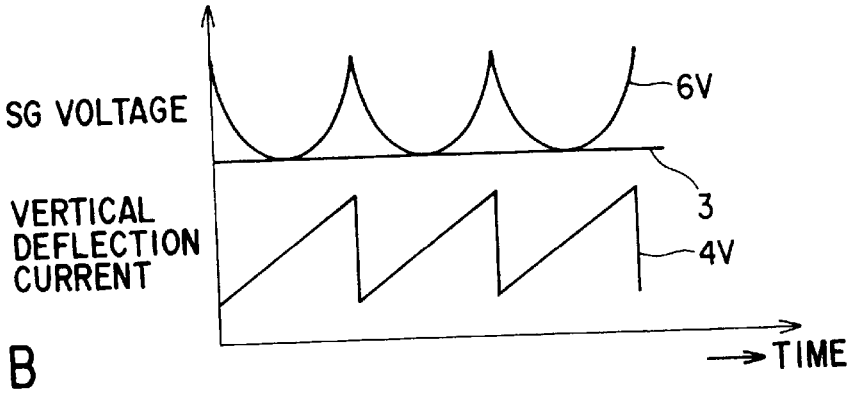
FIG. 11B is a graph showing a voltage applied to the supplementary grid in synchronization with a vertical deflection current.

As shown in FIGS. 11A and 11B, the supplementary grid SG is applied with voltages 6H and 6V which parabolically increase in accordance with an increase of the deflection amount of electron beams in synchronization with a horizontal deflection current 4H and a vertical deflection current 4V, with respect to a reference voltage of a voltage 3 equivalent to the potential of an equipotential surface generated at the position where the supplementary grid SG is provided. In other words, the supplementary grid SG is applied with the lowest voltage equivalent to a reference voltage 3 during a non-deflection period, and is applied with a voltage which increases in accordance with an increase of the deflection amount of electron beams during a deflection period so that the highest voltage is applied when electron beams are deflected toward a peripheral portion of the fluorescent screen.

Figure 12:
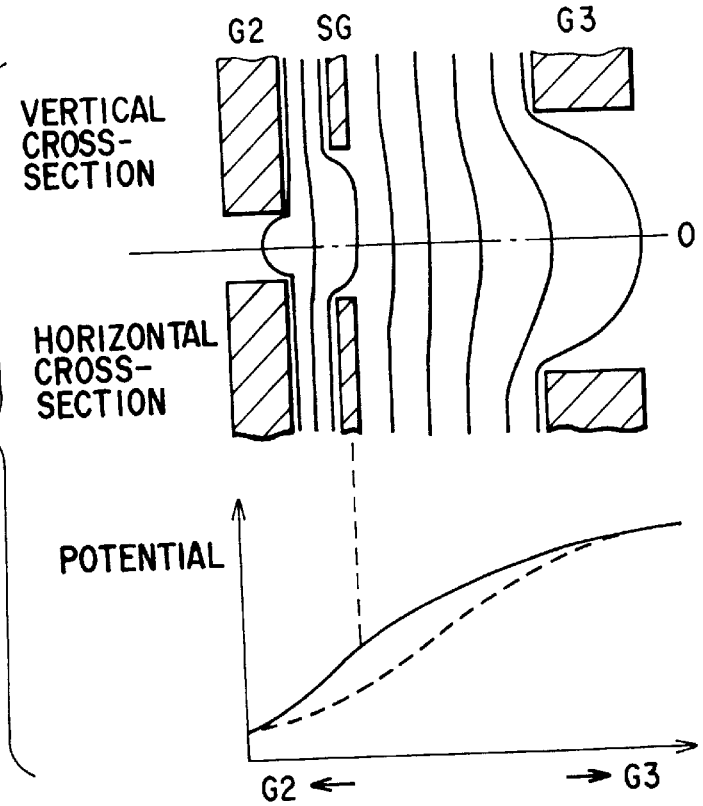
FIG. 12 is a view showing potential distributions formed from the second to third grids in cases of non-deflection and deflection, where voltages as shown in FIGS. 11A and B are applied to the supplementary grid.

Accordingly, a potential distribution as shown in FIG. 12 is obtained on the center axis O of electron beam pass holes from the second grid G2 to the third grid G3. Specifically, a potential distribution as indicated by a broken line is obtained during a non-deflection period, and a potential distribution during a deflection period is higher than that during a non-deflection period, as indicated by a continuous line, in the vicinity of the supplementary grid SG.

As a result of this, during the deflection period, the potential difference between the second grid G2 and the supplementary grid SG increases and the potential difference between the supplementary grid SG and the third grid G3 simultaneously decreases. Therefore, the effect of the electron lens constructed by the second grid G2 and the supplementary grid SG is more dominant. Accordingly, in the pre-focus lens constructed by the second grid G2, the supplementary grid SG, and the third grid G3, the focusing force in the horizontal direction is stronger than the focusing force in the vertical direction, thereby forming a non-rotation-symmetrical lens having a negative astigmatic aberration, resulting in the same effect as described before can be obtained.

Next, explanation will be made of an example in which the features of the present invention are applied to an electron gun adopting a double focus method of a QPF (Quadruple Potential Focus) type.

Figure 13:
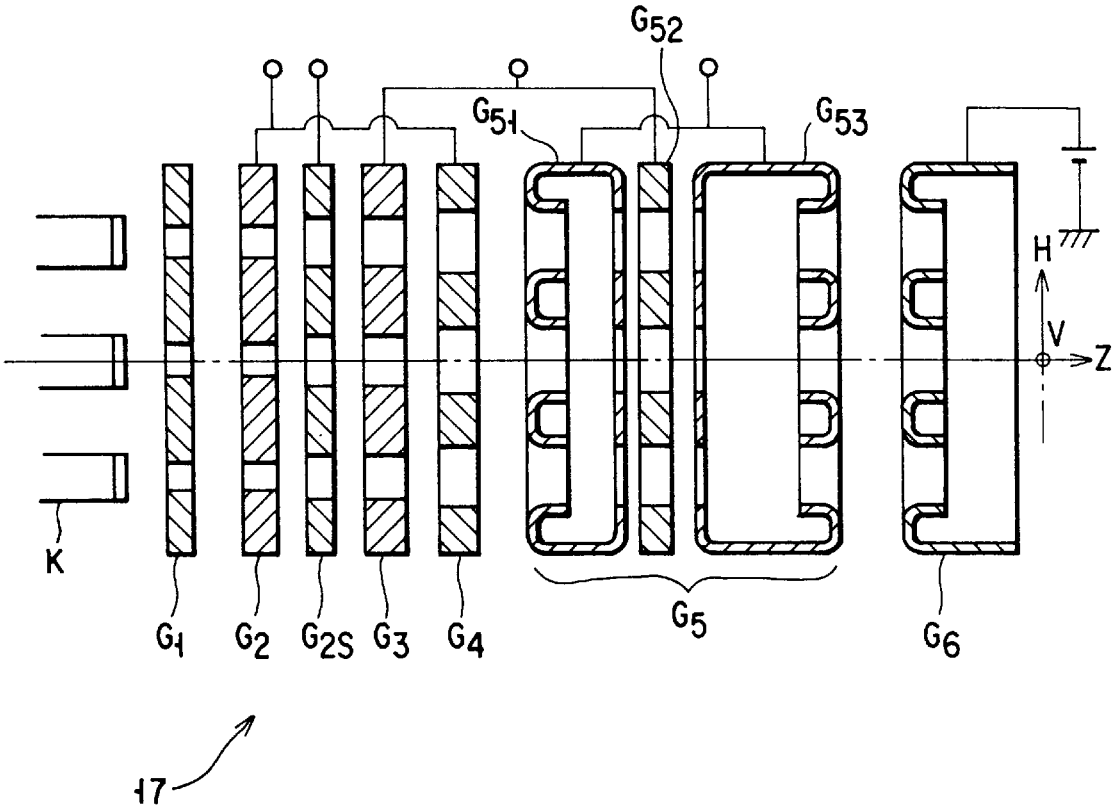
FIG. 13 is a horizontal cross-sectional view schematically showing the structure of an electron gun adopting a Quadruple Potential Focus type double focus method, applied to the color cathode ray tube shown in FIG. 3.

FIG. 13 is a view schematically showing the structure of an electron gun adopting a QPF type double focus method, which emits three electron beams and is applied to the color cathode ray tube shown in FIG. 3.

As shown in FIG. 13, the electron gun 17 comprises three cathodes K arranged in line in the H-axis direction, three heaters (not shown) for respectively heating the cathodes K, and first to sixth grids G1 to G6 provided at predetermined intervals along the Z-axis direction from the cathodes K. The fifth grid G5 includes first, second, and third segments G51, G52, and G53 provided in this order in the Z-axis direction from the fourth grid. In addition, a supplementary grid G2S is provided between the second grid G2 and the third grid G3.

The first grid G1, the second grid G2, the third grid G3, the fourth grid G4, and the second segment G52 of the fifth grid G5 are plate-like electrodes. In each of these plate-like electrodes, three electron beam pass holes each having a substantially circular shape are formed in line in the horizontal direction, so as to correspond to three cathodes K. The first segment G51 and the third segment G53 of the firth grid G5 are tube-like electrodes, and three electron beam pass holes each having a substantially circular shape are formed in line in the horizontal direction, corresponding to the three cathodes K, in each of those surfaces of these tube-like electrodes facing any adjacent grid. The sixth grid G6 is a cup-like electrode, and three electron beam holes each having a substantially circular shape are formed in line in the horizontal direction, corresponding to the three cathodes K, in the surface of this electrode facing an adjacent grid.

As has been explained with reference to FIG. 5, the supplementary grid G2S is a plate-like electrode, and three electron beam pass holes SGr, SGg, and SGb each having a non-circular shape are formed in line in the horizontal direction, corresponding to the three cathode K, in this electrode. Each of the three electron beam pass holes SGr, SGg, and SGb is formed such that the diameter in the H-axis direction is larger than the diameter in the V-axis direction. In the example shown in FIG. 5, each of the three electron beam pass holes SGr, SGg, and SGb is laterally elongated and is formed in a rectangular shape having a long side in the H-axis direction and a short side in the V-axis direction.

In the electron gun 17, a voltage of about 150 V is applied to each cathode K. The first grid G1 is grounded, and the second grid G2 is applied with a voltage of about 800 V. The third grid G3 is applied with a voltage of about 6 kV. The fourth grid G4 is connected with the second grid G2 in the tube, and is applied with a voltage of about 800 V. The second segment G52 of the fifth grid G5 is connected with the third grid G3 in the tube, and is applied with a voltage of about 6 kV. The first segment G51 is connected with the third segment G53 in the tube. The first segment G51 and the third segment G53 of the fifth grid G5 are applied with voltages which dynamically change in synchronization with a magnetic field generated by a deflection yoke, with respect to a reference voltage of about 6 kV applied to the second segment G52, i.e., voltages which parabolically increase in synchronization with a horizontal deflection current and a vertical deflection current. The sixth grid G6 is applied with a voltage of about 26 kV.

The supplementary grid G2S is applied with voltages which dynamically change in synchronization with the deflection magnetic field generated by the deflection yoke. Specifically, as shown in FIGS. 6A and 6B, the supplementary grid G2S is applied with voltages 5H and 5V which decrease parabolically in synchronization with a horizontal deflection current 4H and a vertical deflection current 4V, with respect to a reference voltage of a voltage 3 applied to the second grid G2.

By applying voltages as described above, electron beams are generated and an electron beam generating section for forming a virtual object point with respect to a main lens is constructed, by the cathodes K and the first and second grids G1 and G2. A pre-focus lens for preliminarily focusing electron beams emitted from the electron beam generating section is constructed by the second grid G2, the supplementary grid G2S, and the third grid G3. A sub-lens for further focusing the electron beams preliminarily focused is constructed by the third grid G3, the fourth grid G4, and the first segment G51 of the fifth grid G5. A quadrupole lens for correcting a deflection aberration is constructed by the first to third segments G51, G52, and G53 of the fifth grid G5. A main lens for finally focusing the electron beams onto the fluorescent screen is constructed by the third segment G53 of the fifth grid G5 and the sixth grid G6.

In this electron gun, during a non-deflection period, electron beams are preliminarily focused by the pre-focus lens. In this case, since electron beam pass holes each of which is not circular and has a longer diameter in the horizontal direction than in the vertical direction are formed in the supplementary grid G2S, electron beams receives a weak negative astigmatic aberration in which the focusing force in the vertical direction is stronger than that in the horizontal direction. As a result, the diameter of a virtual object point with respect to the main lens is reduced in the horizontal direction and the divergence angle in the horizontal direction is enlarged.

The electron beams thus preliminarily focused by the pre-focus lens are further preliminarily focused by the sub-lens. In this case, since no electron lens is formed between the three segments G51, G52, and G53 of the fifth grid G5, the electron beams preliminarily focused by the sub-lens pass through the three segments G51, G52, and G53, and are thereafter focused finally by a main lens, to enter into the center of the fluorescent screen.

As a result of this, as shown in FIG. 9, the beam spot of an electron beam entering into the center of the fluorescent screen has an elliptic shape slightly elongated in the vertical direction by a weak negative astigmatic aberration.

In contrast, during a deflection period, the electron beams are preliminarily focused by the pre-focus lens. In this case, since the voltage applied to the supplementary grid G2S decreases to be smaller than that during a non-deflection period in accordance with an increase of the deflection amount, the electron beams receive a strong negative astigmatic aberration. In this manner, the diameter of a virtual object point with respect to the main lens is smaller in the horizontal direction than that during a non-deflection period while the diameter of a virtual object point is enlarged in the vertical direction. The divergence angle in the horizontal direction is enlarged while the divergence angle in the vertical direction is reduced, in comparison with those in a non-deflection period.

The electron beams thus preliminarily focused by the pre-focus lens are further focused by a sub-lens. In this case, since the first and third segments G51 and G53 of the fifth grid G5 are applied with a voltage which increases in accordance with an increase of the deflection amount with respect to a reference voltage of a voltage applied to the second segment G52, the electron beams receive a positive astigmatic aberration in which the focusing force in the horizontal direction is stronger that in the vertical direction, from the first to third segments G51, G52, and G53. As a result, the divergence angles of the electron beams changed by the pre-focus lens are corrected, and further, the electron beams are subjected to correction of a deflection aberration. Thereafter, the electron beams are finally focused by a main lens, and enter into a peripheral portion of the fluorescent screen.

The diameter of an electron beam entering into a peripheral portion of the fluorescent screen is reduced in the horizontal direction, since the diameter of a virtual object point is reduced in the horizontal direction by a strong negative astigmatic aberration caused by a supplementary grid G2S. Meanwhile, since the diameter of a virtual object point is enlarged in the vertical direction, the vertical diameter of the beam spot is enlarged. As a result of this, as shown in FIG. 9, elliptic deformation is absorbed, so that the beam spot of an electron beam entering into a peripheral portion of the fluorescent screen has a substantially circular shape.

Accordingly, by constructing an electron gun in a structure as described above, elliptic deformation of beam spots can be absorbed over the entire surface of the screen so that the beam spots have substantially circular shapes. In addition, focusing characteristic can be uniform over the entire surface of the screen, so that a color cathode ray tube capable of displaying an excellent image can be constructed.

As has been described above, according to the present invention, the color cathode ray tube has an electron gun comprised of an electron beam generating section, a pre-focus lens, and a main lens. The electron beam generating section is constructed by cathodes, a first grid, and a second grid, and functions to generate electron beams. The pre-focus lens is constructed by a second grid and a third grid, and functions to preliminarily focus the electron beams emitted from the electron beam generating section. The main lens is constructed by a third grid and at least one other grid, and functions to finally focus the electron beams preliminarily focused by the pre-focus lens, onto a fluorescent screen. In the cathode ray tube described above, a supplementary grid having electron beam pass holes each having a longer axis in the horizontal direction is provided between the second and third grids, and the supplementary grid is applied with a voltage which dynamically changed in synchronization with a deflection current supplied to a deflection yoke for deflecting electron beams.

In an electron gun of an inline type adopting a Dynamic Astigmatism Correct and Focus method, the voltage applied to the supplementary grid is set to such a voltage that provides the same potential distribution on the center axis of the electron beam pass holes from the second grid to the third grid as that obtained by a bi-potential type electron lens, during a non-deflection period when electron beams are made run to the center portion of the fluorescent screen.

As a result, a pre-focus lens constructed by the second grid and the third grid is equivalent to a bi-potential type electron lens which has no no-point aberration and has a rotation symmetric shape. Accordingly, a virtual object point with respect to the main lens of the electron gun has an equal diameter in both the horizontal and vertical directions, so that an electron beam which has reached the center portion of the fluorescent screen has a circular spot shape.

Meanwhile, during a deflection period when electron beams are deflected toward a peripheral portion of the fluorescent screen, the voltage applied to the supplementary grid is set to be lower than that applied during a non-deflection period. Specifically, the potential in the vicinity of the supplementary grid on the potential distribution on the center axis of electron beam pass holes from the second grid to the third grid is set to be lowered than that during a non-deflection period, so that the potential difference between the second grid and the supplementary grid is decreased while the potential difference between the supplementary grid and the third grid is increased. Therefore, the effect of the electron lens constructed by the supplementary grid and the third grid is dominant.

As a result, the pre-focus lens becomes a non-rotation-symmetrical lens having a negative astigmatic aberration since the focusing force thereof is stronger in the horizontal direction than in the vertical direction. Accordingly, the diameter of a virtual object point with respect to the main lens is smaller in the horizontal direction and is larger in the vertical direction, than that during a non-deflection period. In addition, the divergence angle of the electron beams is enlarged in the horizontal direction and is reduced in the vertical direction, in comparison with that during a non-deflection period. Therefore, the diameter of an electron beam which has reached the fluorescent screen is reduced in the horizontal direction and is enlarged in the vertical direction, so that elliptic deformation of electron beam spots are absorbed in a peripheral portion of the fluorescent screen.

As a result of this, an image with excellent image quality can be displayed over the entire screen of the fluorescent screen.

In addition, in an electron gun adopting a QPF (Quadruple Potential Focus) type double focus method, a second grid, a supplementary grid, and a third grid are arranged so as to provide an astigmatic aberration in which the focusing force is stronger in the vertical direction than in the horizontal direction, and the strength of the astigmatic aberration is dynamically changed by a voltage which is applied to the supplementary grid and dynamically change.

By constructing a structure as described above, the diameter of a virtual object point of an electron beam can be dynamically changed, lateral deformation of beam spots in the horizontal direction can be absorbed at a peripheral portion of the screen, and focusing characteristic can be uniform over the entire surface of the screen, so that a excellent image can be displayed.

As has been explained above, according to the present invention, it is possible provide a color cathode ray tube in which excellent focusing characteristic of electron beams can be maintained over the entire surface of the fluorescent screen, and elliptic deformation of electron beam spots can be reduced over the entire surface of the fluorescent screen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

We claim:

1. A color cathode ray tube comprising:

an electron gun including an electron beam generating section constructed by a cathode, first and second grids sequentially provided next to the cathode and apart from each other by a predetermined distance, to generate three electron beams arranged in line in a horizontal direction, a pre-focus lens constructed by the second grid and a third grid provided next to and apart from the second grid by a predetermined distance, to preliminarily focus the electron beams emitted from the electron beam generating section, a main lens constructed by the third grid and at least one other grid provided next to and apart from the third grid by a predetermined distance, to finally focus the electron beams preliminarily focused by the pre-focus lens, onto a fluorescent screen; and a deflection yoke for generating a pin-cushion type horizontal deflection magnetic field in which the electron beams emitted by the electron gun are deflected in the horizontal direction, and a barrel type vertical deflection magnetic field in which the electron beams are deflected in a vertical direction, characterized in that the electron gun includes a supplementary grid which is provided between the second and third grids and which is combined together with the second and third grids to construct an electron lens having an astigmatic aberration in which a focusing force in the vertical direction is stronger than a focusing force in the horizontal direction, and the supplementary grid is applied with a voltage which dynamically changes in synchronization with the magnetic fields generated by the deflection yoke, thereby to dynamically change an intensity of the astigmatic aberration of the electron lens.

2. A color cathode ray tube according to claim 1, characterized in that the supplementary grid is applied with a voltage which decreases in synchronization with a deflection current supplied to the deflection yoke, from a reference voltage of a voltage applied to the second grid.

3. A color cathode ray tube according to claim 1, characterized in that the electron gun includes at least three other adjacent grids for constructing a quadrupole lens, than the first to third grids, the quadrupole lens has an astigmatic aberration in which a focusing force in the horizontal direction is stronger than a focusing force in the vertical direction, and an intensity of the astigmatic aberration of the quadrupote lens is dynamically changed by a voltage which dynamically changes and is applied to one of the three other grids positioned in a middle among the three other grids.

4. A color cathode ray tube according to claim 3, characterized in that the supplementary grid is applied with a voltage which decreases in synchronization with a deflection current supplied to the deflection yoke, from a reference voltage of a voltage applied to the second grid, and ones of the three other grids positioned in both ends of the three other grids are applied with a voltage which increases in synchronization with the deflection current supplied to the deflection yoke, from a reference voltage of the voltage applied to the grid positioned in the middle.

5. A color cathode ray tube according to claim 1, characterized in that the supplementary grid has an electron beam pass hole having a longer axis in the vertical direction and an longitudinally elongated shape.

6. A color cathode ray tube comprising:

an electron gun including an electron beam generating section constructed by a cathode, first and second grids sequentially provided next to the cathode and apart from each other by a predetermined distance, to generate three electron beams arranged in line in a horizontal direction, a pre-focus lens constructed by the second grid and a third grid provided next to and apart from the second grid by a predetermined distance, to preliminarily focus the electron beams emitted from the electron beam generating section, a main lens constructed by the third grid and at least one other grid provided next to and apart from the third grid by a predetermined distance, to finally focus the electron beams preliminarily focused by the pre-focus lens, onto a fluorescent screen; and a deflection yoke for generating a pin-cushion type horizontal deflection magnetic field in which the electron beams emitted by the electron gun are deflected in the horizontal direction, and a barrel type vertical deflection magnetic field in which the electron beams are deflected in a vertical direction, characterized in that the electron gun includes a supplementary grid which is provided along an equipotential surface of a potential difference between the second and third grids, an electron beam pass hole having a non-circular shape is formed in the supplementary grid, and the supplementary grid is applied with a voltage which dynamically changes in synchronization with a deflection current supplied to the deflection yoke such that the voltage applied to the supplementary grid is a predetermined level equivalent to a potential of the equipotential surface where the supplementary grid is provided during a non-deflection period when the electron beams are oriented so as to reach a center portion of the fluorescent screen while the voltage applied to the supplementary grid is a voltage having a difference from the voltage of the predetermined level, which increases in accordance with an increase of a deflection amount of the electron beams, during a deflection period when the electron beams are deflected to a peripheral portion of the fluorescent screen.

7. A color cathode ray tube according to claim 6, characterized in that the voltage applied to the supplementary grid is a voltage which dynamically changes in synchronization with a deflection current supplied to the deflection yoke, and is also such a voltage by which a potential distribution on a center axis of the electron beam pass hole between the second and third grids becomes equal to that of a bi-potential type electron lens, during the non-deflection period, and by which a potential distribution in vicinity of a position where the supplementary grid is provided becomes different from that during the non-deflection period, during the deflection period.

8. A color cathode ray tube according to claim 6, characterized in that the supplementary grid has an electron beam pass hole having a laterally elongated shape and a longer axis in the horizontal direction, and the voltage applied to the supplementary grid is a voltage which is decreased to be lower than the voltage of the predetermined level applied during the non-deflection period, in accordance with the increase of the deflection amount of the electron beams, during the deflection period.

9. A color cathode ray tube according to claim 6, characterized in that the supplementary grid has an electron beam pass hole having an longitudinally elongated shape and a longer axis in the vertical direction, and the voltage applied to the supplementary grid is a voltage which is increased to be higher than the voltage of the predetermined level applied during the non-deflection period, in accordance with the increase of the deflection amount of the electron beams, during the deflection period.

10. A color cathode ray tube according to claim 6, characterized in that the third grid has at least two segments which construct a quadrupole lens, and the quadrupole lens has an astigmatic aberration in which a focusing force in the horizontal direction is stronger than a focusing force in the vertical direction, and an intensity of the astigmatic aberration of the quadrupole lens is dynamically changed by a voltage which is applied to one of the segments and which dynamically changes.

* * * * *

UNITED STATES PATENT AND TRADEMARK OFFICE

CERTIFICATE OF CORRECTION

PATENT NO. : 5,994,826

DATED : November 30, 1999

INVENTOR(s) : Hirofumi UENO; Tsutomu TAKEKAWA

It is certified that error appears in the above-identified patent and that said Letters Patent is hereby corrected as shown below:

On the tile page, please add to item

--[30] Foreign Application Priority Data

Jan. 30, 1997 [JP] Japan . . . . . .9-016297

Dec. 4, 1997 [JP] Japan . . . . . .9-334368--.

Signed and Sealed this

Twenty-third Day of January, 2001

*Attest:*

*Attesting Officer*

Q. TODD DICKINSON

*Commissioner of Patents and Trademarks*